US008437496B2

(12) United States Patent
Frasl

(10) Patent No.: US 8,437,496 B2
(45) Date of Patent: May 7, 2013

(54) MEMBRANE FOR AN ACOUSTIC DEVICE AND ACOUSTIC DEVICE

(75) Inventor: Ewald Frasl, Biedermannsdorf (AT)

(73) Assignee: Knowles Electronics Asia PTE. Ltd., Singapore (SG)

( * ) Notice: Subject to any disclaimer, the term of this patent is extended or adjusted under 35 U.S.C. 154(b) by 431 days.

(21) Appl. No.: 12/666,818

(22) PCT Filed: Jun. 20, 2008

(86) PCT No.: PCT/IB2008/052445

§ 371 (c)(1), (2), (4) Date: Dec. 28, 2009

(87) PCT Pub. No.: WO2009/004518

PCT Pub. Date: Jan. 8, 2009

(65) Prior Publication Data

US 2010/0215209 A1 Aug. 26, 2010

(30) Foreign Application Priority Data

Jun. 29, 2007 (EP) ..... 07111363

(51) Int. Cl.
*H04R 25/00* (2006.01)

(52) U.S. Cl.
USPC ..... 381/423; 381/353; 381/424

(58) Field of Classification Search ..... 381/353, 381/354, 396, 398, 423, 424, 425, 426, 430, 381/431; 181/163, 164, 165, 166, 167, 171, 181/172

See application file for complete search history.

(56) References Cited

U.S. PATENT DOCUMENTS

| | | | | |
|---|---|---|---|---|
| 6,154,556 | A * | 11/2000 | Takahashi et al. | 381/430 |
| 6,215,887 | B1 | 4/2001 | Wei et al. | |
| 2001/0017928 | A1 | 8/2001 | Sugiyama et al. | |
| 2006/0153420 | A1 * | 7/2006 | Takase et al. | 381/424 |
| 2007/0202742 | A1 * | 8/2007 | Honda et al. | 439/587 |

FOREIGN PATENT DOCUMENTS

| | | | |
|---|---|---|---|
| JP | 56-157199 | A | 12/1981 |
| JP | 61-121688 | A | 6/1986 |
| JP | 2002-336785 | A | 11/2002 |

OTHER PUBLICATIONS

International Search Report for Int'l Application No. PCT/IB2008/052445 (Oct. 20, 2008).

* cited by examiner

*Primary Examiner* — Huyen D Le
(74) *Attorney, Agent, or Firm* — Steven McMahon Zeller; Dykema Gossett, PLLC

(57) ABSTRACT

A membrane 103 for an acoustic device 100 is provided, the membrane 103, wherein the membrane 103 comprises a central portion 212, an annular portion 105, and a corrugation 107, wherein the annular portion 105 is arranged around the central portion 212, wherein the annular portion 105 is adapted to be fixed to a coil 106, and wherein the corrugation 107 is arranged between the central portion 212 and the annular portion 105. Thus, the corrugation 107 may form an inner corrugation compared to an outer corrugation 104 which would be arranged farther away from the central portion 212 than the annular portion 105.

9 Claims, 4 Drawing Sheets

MEMBRANE FOR AN ACOUSTIC DEVICE AND ACOUSTIC DEVICE

FIELD OF THE INVENTION

The invention relates to a membrane for an acoustic device. Moreover, the invention relates to an acoustic device.

BACKGROUND OF THE INVENTION

Speakers for acoustic devices comprise a membrane which is actuated by a so-called voice coil. For an improved translative movement of the membrane often a so-called corrugation is formed at the membrane around the area in which the voice coil is fixed to the membrane. This corrugation forms a joint, articulation or pivot so that the portion of the membrane which is closer to the center of the membrane than the voice coil, i.e. the portion which forms the interior portion of the membrane is moved more or less translational. However, in case the acoustic pressure exceeds a limit pressure the thin membrane is bulged which leads to a decreased performance of the speaker. Thus, in some cases a plate is fixed to the membrane in the central portion of the membrane in order to stiffening the central portion. However, although such a plate may reduce the bulging, still one or even several oscillations are superimposed to the movement of the membrane. Furthermore, in case a given frequency is exceeded the plate, due to its mass, cannot follow the movement induced by the voice coil and holds still. This given frequency is called cut-off frequency.

OBJECT AND SUMMARY OF THE INVENTION

It is an object of the invention to provide a membrane and an acoustic device having an improved performance.

In order to achieve the object defined above, a membrane for an acoustic device and an acoustic device according to the independent claims are provided.

According to an exemplary embodiment a membrane for an acoustic device is provided, wherein the membrane comprises a central portion, an annular portion, and a corrugation, wherein the annular portion is arranged around the central portion, wherein the annular portion is adapted to be fixed to a coil, and wherein the corrugation is arranged between the central portion and the annular portion. Thus, the corrugation may form an inner corrugation compared to an outer corrugation which would be arranged farther away from the central portion than the annular portion. In particular, the coil may be a voice coil.

According to an exemplary embodiment an acoustic device is provided, wherein the acoustic device comprises a membrane according to an exemplary embodiment and a coil, wherein the membrane is fixed to the coil at the annular portion of the membrane. In particular, the acoustic device may be a speaker.

The term "acoustic device" may particularly denote any device for processing, recording, and/or playing sounds, like radio, CD-player, MP-player, i.e. devices comprising in general at least one speaker or one microphone which may comprise a membrane, or even parts thereof, e.g. a single speaker or a single microphone.

The term "inner" may in particular denote that the respective object, e.g. the "inner corrugation", is arranged closer to the center than another object, e.g. an outer corrugation. Thus, a direction may in particular be defined along a radius of the annular portion. In particular, the term "between the central portion and the annular portion" may refer to this direction, i.e. along a radial direction of the annular portion.

A membrane comprising a corrugation closer to the central portion of the membrane than an annular portion which is adapted in such a way that a voice coil is fixable may exhibit some surprising advantages. Such an inner corrugation may form a joint, articulation or pivot so that the node and therefore the cut-off frequency may be exactly defined. In particular, the cut-off frequency may be decreased in case the inner corrugation is shifted to the annular portion, i.e. farther away from the central portion or center of the membrane. On the other side, the cut-off frequency may be increased in case the inner corrugation is shifted into the direction of the center of the membrane.

Furthermore, such an inner corrugation may act as a barrier for glue in case a voice coil is glued to the annular portion of the membrane. Due to such a barrier it may be possible that the node of the oscillating or vibrating membrane may be more precisely defined, since the glue may not spread towards the center of the membrane. Thus, a thickening and stiffening of the membrane may be prevented or at least reduced. In particular, it may be possible to reduce the variation of the cut-off frequency between different membranes and respective speakers, which, at least partially, may be induced due to a different spreading of the glue.

Next, further exemplary embodiments of the membrane will be explained. However, these embodiments also apply to the acoustic device.

According to another exemplary embodiment of the membrane the corrugation is annular shaped. In particular, the corrugation is formed substantially parallel to the annular portion. For example, the annular portion and the corrugation may have a circular shape or at least a substantially circular shape.

According to another exemplary embodiment of the membrane a plate is fixed to the membrane. In particular, the plate may be glued to the membrane at least at the central portion of the membrane. For example the plate may be made of polystyrene or another suitable material. In particular, the plate may extend from the central portion over the corrugation to the annular portion. That is, for a circular shaped annular portion the plate may have a diameter which is greater than the diameter of the circular shaped annular portion.

Such a plate may in particular advantageous for stiffening the membrane in the central portion so that a bulging of the membrane may be prevented or reduced at least in the central portion of the membrane.

According to another exemplary embodiment of the membrane the plate is fixed to the membrane at the annular portion and the central portion. In particular, the plate may be free at the corrugation. The term "free" may particularly denote that the plate is not fixed or is unsecured to the membrane at the corrugation or in the region of the corrugation, e.g. not glued to the membrane at this position or area. For example, a hollow space or at least a space which is not filled with glue or an adhesive may be formed between the membrane and the plate at the region of the corrugation.

Next, further exemplary embodiments of the acoustic device will be explained. However, these embodiments also apply to the membrane.

According to another exemplary embodiment of the acoustic device the membrane is fixed to the coil by glue. That is, the membrane may be glued to the coil. In particular, the glue may be arranged at least in the region between the annular portion and the corrugation. As glue every suitable adhesive may be used.

According to another exemplary embodiment of the acoustic device the central part of the membrane is free of glue. In particular, the glue or the glued portion may not extend over the corrugation. For example, the glue may extend to the corrugation but not over the corrugation. That is, the glue may extend at most to the middle of the corrugation. In particular, both sides of the membrane may be free of glue in the region of the inner corrugation.

Summarizing an exemplary aspect of the invention may be that a membrane is provided which comprises an inner corrugation. That is, a corrugation which is formed closer to the central portion or center of the membrane than the portion or area which is adapted to be fixed to a voice coil and which is called annular portion above. In particular, the membrane and the inner corrugation are circular shaped. At the position of the corrugation a plate used for stiffening the membrane may not be glued to the membrane so that the corrugation may "soften" the membrane and may function as a joint or an articulation. Thus, a node of an oscillation or vibration of the membrane may be more precisely defined than in common membranes which have no inner corrugations. Furthermore, this inner corrugation may act as a barrier or barricade for glue used for gluing the membrane to the voice coil.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

DESCRIPTION OF EMBODIMENTS

Figure 1:
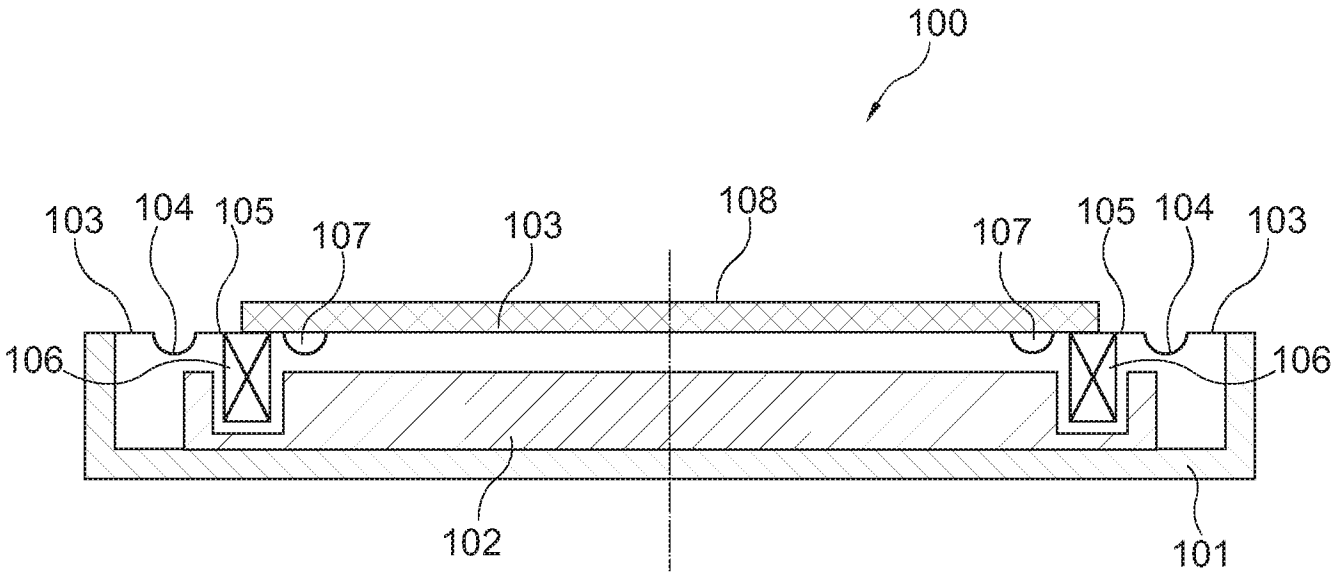
FIG. 1 schematically shows a portion of a speaker.

The illustration in the drawing is schematically. In different drawings, similar or identical elements are provided with the similar of identical reference signs.

FIG. 1 schematically illustrates a cross sectional view of a portion of a speaker 100. The speaker 100 comprises a housing 101 having a magnet system 102, commonly a permanent magnet, fixed thereto. Furthermore, the speaker comprises a membrane 103 which is glued to the housing 101 at the outer portion of the membrane 103. The membrane comprises an outer corrugation 104. Further to the center of the membrane than the outer corrugation the membrane comprises an annular portion 105 which is adapted in such a way that a voice coil 106 is fixable. In FIG. 1 the voice coil 106 is schematically depicted. The voice coil 106 engages into a recess of the magnet system 102 and is used to actuate the membrane 103. Furthermore, the membrane comprises an inner corrugation 107 which is slightly indicated in FIG. 1 and which can be seen clearer in FIG. 2. Furthermore, a plate 108 is glued to the membrane 103 for stiffening the same.

Figure 2:
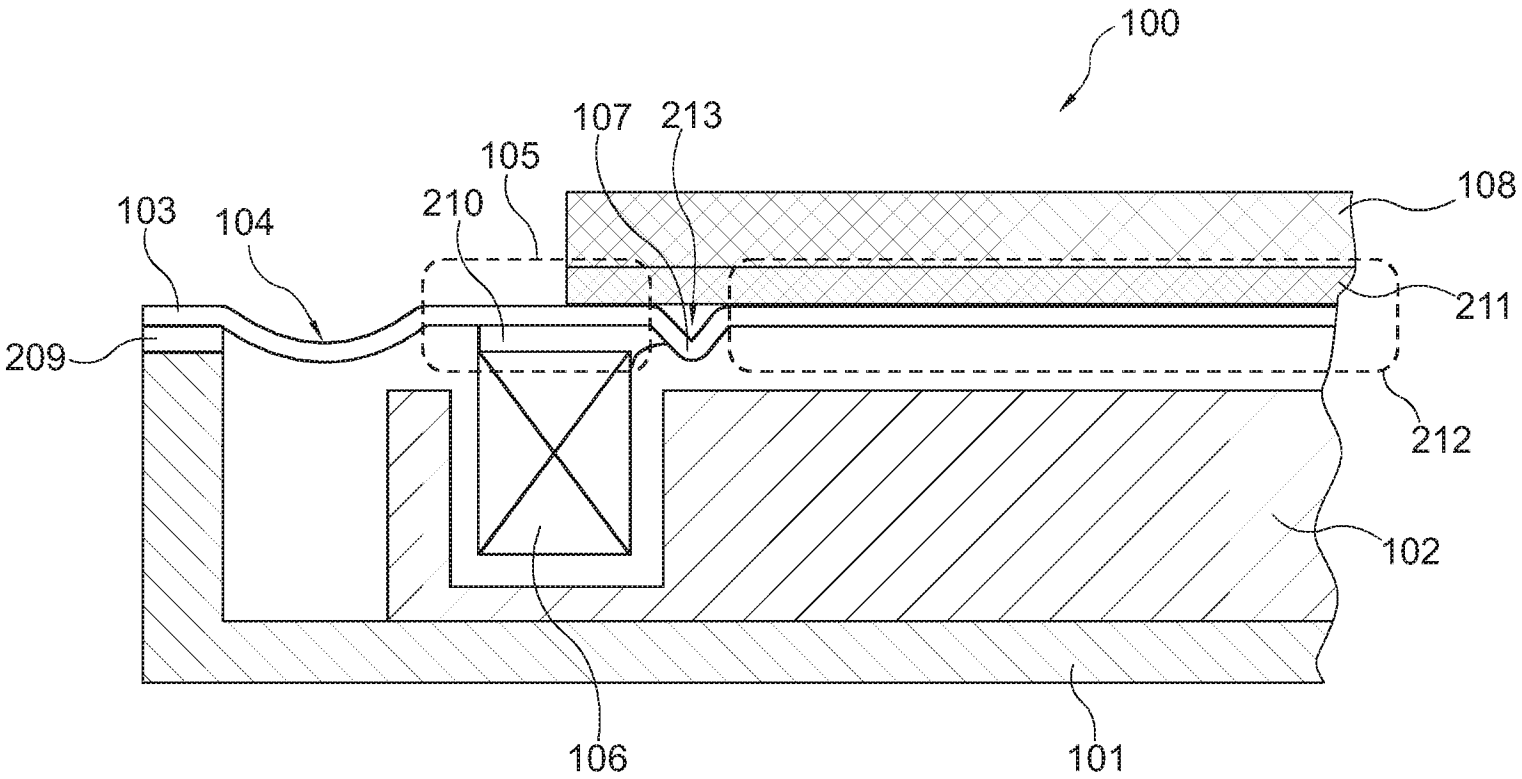
FIG. 2 schematically shows an enlarged view of the speaker of FIG. 1.

FIG. 2 schematically shows an enlarged view of a portion of the speaker of FIG. 1. As in FIG. 1, FIG. 2 shows the housing 101 and the magnet system 102. Further, the membrane 103 is glued to the housing 101 at the outer portion of the membrane 103, which is indicated in FIG. 2 by the glue 209. Furthermore, the membrane 103 comprises the outer corrugation 104 and the annular portion 105 to which the voice coil 106 is fixed, which fixing is indicated by glue 210. In FIG. 2 it is shown that the inner corrugation 107 acts as a barrier for the glue 210, i.e. the glue only extends to roughly the middle of the inner corrugation 107. Thus, the inner corrugation may not only acts as a joint for the vibrating membrane but also prevents that the glue 210 extends further to the middle or center of the membrane 103. Furthermore, the plate 108 is shown in FIG. 2 which is as well glued by glue 211 to the membrane 103. In particular, the plate 110 is glued to the membrane 103 in a central portion 212 and in parts of the annular portion 105 on the membrane, but not in the region of the inner corrugation 107. Thus, the inner corrugation 107 is not fixed to the plate 108 and a hollow space 213 is formed between the plate or the glue 211 and the membrane 103. In particular, the inner corrugation is arranged between the annular portion 105 and a central portion 212.

Figure 3A:
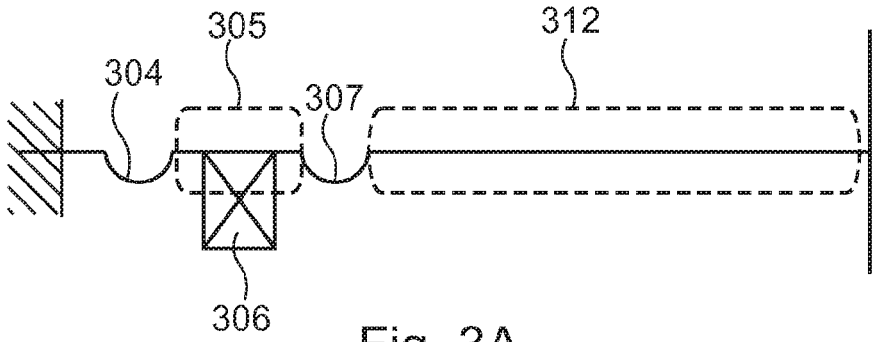
FIG. 3 schematically shows different oscillation states of a membrane according to an exemplary embodiment.

FIG. 3 schematically shows different oscillation states of a membrane according to an exemplary embodiment. In particular, FIG. 3A shows a membrane 303 in the idle state, i.e. in a state a coil 306 fixed to the membrane 303 does not actuate the membrane. In the idle state an outer corrugation 304 and an inner corrugation 307 are not actuated and substantially semicircular in shape.

Figure 3B:
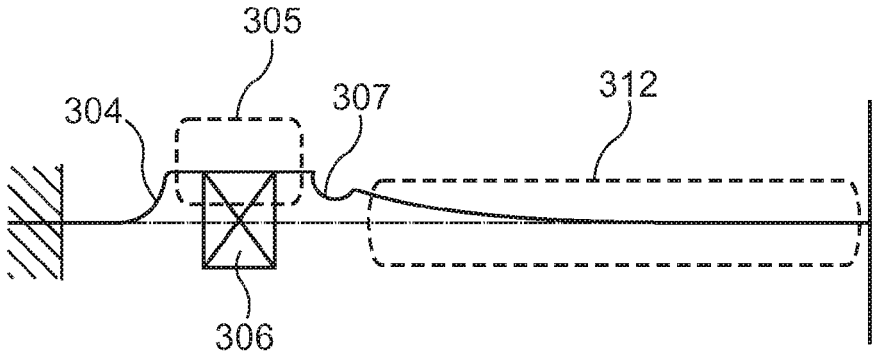

In FIG. 3B the membrane 303 of FIG. 3A is shown in an actuated state, i.e. in a state the coil 306 actuates the membrane. In particular, FIG. 3B shows the membrane in an upper dead point of an oscillation. In that state both corrugations are deformed with respect to the state shown in FIG. 3A. In particular, the outer corrugation 304 is deformed into a substantially fourth part of a circle, while the inner corrugation is slightly deformed, so that a joint is formed by the inner corrugation defining a node of the oscillation of the membrane 303.

Figure 3C:
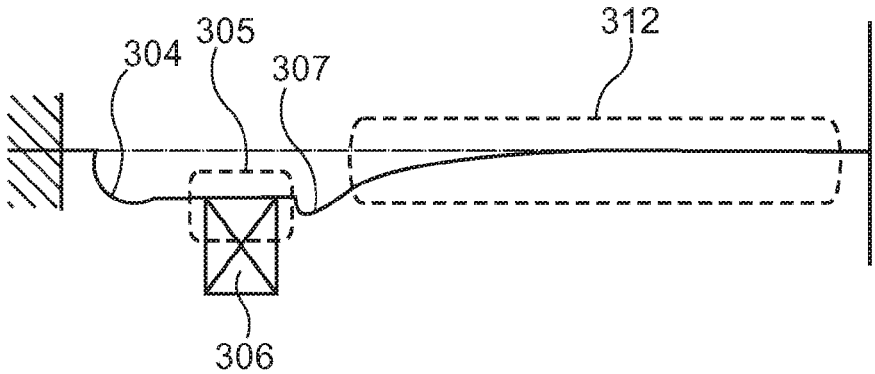

In FIG. 3C the membrane 303 of FIG. 3C is shown in an actuated state, i.e. in a state the coil 306 actuates the membrane. In particular, FIG. 3B shows the membrane in a lower dead point of an oscillation. In that state both corrugations are deformed with respect to the state shown in FIG. 3A. In particular, the outer corrugation 304 is deformed into a substantially fourth part of a circle, while the inner corrugation is slightly deformed, so that a joint is formed by the inner corrugation defining a node of the oscillation of the membrane 303.

It should be noted that the oscillation amplitude in the inner region, i.e. the central portion, is magnified and not to scale in FIG. 3A and FIG. 3B. For illustrative reasons in FIG. 3 also a central portion 312 and an annular portion 305 are indicated.

Figure 4:
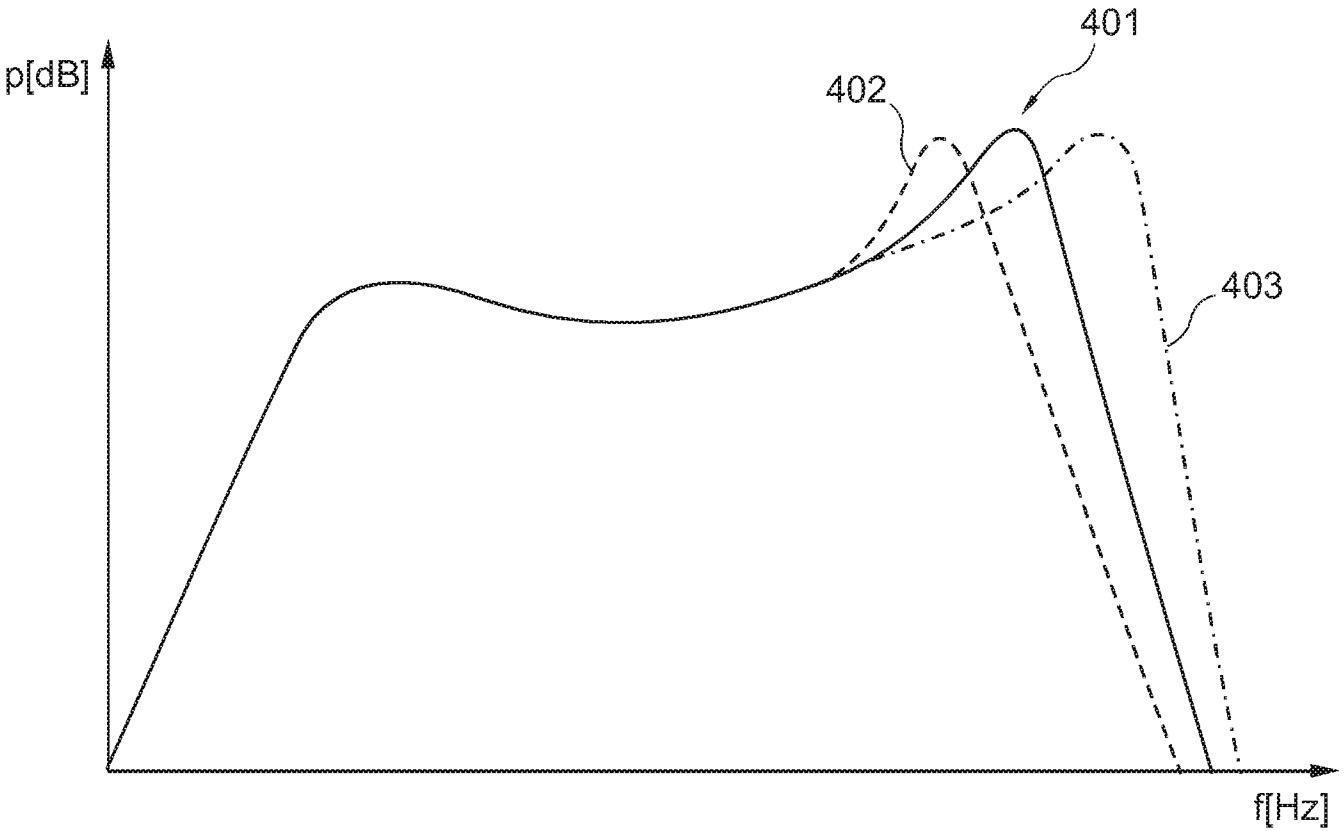
FIG. 4 schematically shows the effect of the placing of an inner corrugation on the cut-off frequency.

FIG. 4 schematically shows the effect of the placing of an inner corrugation on the cut-off frequency. In particular, FIG. 4 shows schematically an acoustic pressure in decibel over the respective frequency in Hertz. On the right side, i.e. the end referring to the high frequency, the cut-off frequency is schematically depicted by the steep decrease in acoustic pressure. In FIG. 4 cut-off frequencies for three positions of an inner corrugation are shown. A first line 401 indicates the cut-off frequency of a first position of the inner corrugation. A second line 402 shows the cut-off frequency in case the inner corrugation is shifted farther away from the center of the membrane. In that case the cut-off frequency is shifted to a lower frequency value. A third line 403 shows the effect of shifting the inner corrugation closer to the center of the membrane. In that case the cut-off frequency is shifted to a higher frequency value.

Finally, it should be noted that the above-mentioned embodiments illustrate rather then limit the invention, and that those skilled in the art will be capable of designing many alternative embodiments without departing from the scope of the invention as defined by the appended claims. In the claims, any reference signs placed in parentheses shall not be construed as limiting the claims. The word "comprising" and "comprises", and the like, does not exclude the presence of elements or steps other than those listed in any claim or the specification as a whole. The singular reference of an element does not exclude the plural reference of such elements and vice-versa. In a device claim enumerating several means, several of these means may be embodied by one and the same item of software or hardware. The mere fact that certain measures are recited in mutually different dependent claims does not indicate that a combination of these measures cannot be used to advantage.

The invention claimed is:

1. A membrane for an acoustic device, the membrane comprising:

a central portion, an annular portion arranged around the central portion, the annular portion being adapted to be fixed to a coil, a corrugation arranged between the central portion and the annular portion, and a plate fixed to the membrane, the plate extending from the central portion over the corrugation to the annular portion.

2. The membrane according to claim 1, wherein the corrugation is annular shaped.

3. The membrane according to claim 1, wherein the plate is fixed to the membrane at the annular portion and the central portion.

4. The membrane according to claim 3, wherein the plate is free at the corrugation.

5. An acoustic device comprising:

a membrane comprising:

a central portion;

an annular portion arranged around the central portion; and a corrugation arranged between the central portion and the annular portion;

a coil; and a plate fixed to the membrane, the plate extending from the central portion over the corrugation to the annular portion;

wherein the membrane is fixed to the coil at the annular portion of the membrane.

6. The acoustic device according to claim 5, wherein the membrane is fixed to the coil by glue.

7. The acoustic device according to claim 6, wherein the glue is present at the annular portion and between the annular portion and the corrugation.

8. The acoustic device according to claim 7, wherein the central portion of the membrane is free of glue.

9. The acoustic device according to claim 7, wherein corrugation is configured to prevent the glue from extending from the annular portion to the central portion.

* * * * *